US005102248A

United States Patent [19]

Welschoff

[11] Patent Number: 5,102,248

[45] Date of Patent: Apr. 7, 1992

[54] APPLICATOR FOR SOFT MATERIALS WITH TIP FORMING MEANS

[75] Inventor: Heinz Welschoff, Fort Lauderdale, Fla.

[73] Assignee: Heinz Industries, Inc., Pompano Beach, Fla.

[21] Appl. No.: 604,359

[22] Filed: Oct. 26, 1990

Related U.S. Application Data

[63] Continuation of Ser. No. 025,856, Mar. 16, 1987, abandoned, which is a continuation-in-part of Ser. No. 825,247, Feb. 3, 1986, abandoned, and a continuation-in-part of Ser. No. 852,342, Apr. 15, 1986, abandoned.

[51] Int. Cl.[5] ..... A45D 40/08

[52] U.S. Cl. ..... 401/50; 401/75; 401/98; 401/173; 401/51

[58] Field of Search ..... 401/50, 51, 173, 75, 401/98

[56] References Cited

U.S. PATENT DOCUMENTS

| | | | |
|---|---|---|---|
| 527,803 | 10/1894 | McCollum | 401/51 |
| 1,055,028 | 3/1913 | Flynn et al. | 401/173 X |
| 1,270,914 | 7/1918 | Zimdars | 401/51 |
| 1,861,466 | 6/1932 | Bafetti | 401/51 |
| 2,209,849 | 7/1940 | Seguin | 401/51 |
| 2,559,889 | 7/1951 | Matthews | 401/50 X |
| 2,606,527 | 8/1952 | Filak | 401/51 |
| 2,665,696 | 1/1954 | Weis | 401/51 |
| 2,979,029 | 4/1961 | Melnikoff | 401/51 |
| 3,077,183 | 2/1963 | Spatz | 401/51 |
| 3,209,730 | 10/1965 | Aston | 401/50 X |
| 3,232,276 | 2/1966 | Kupersmith et al. | 401/51 |
| 3,256,980 | 6/1966 | Bau | 401/75 |

FOREIGN PATENT DOCUMENTS

| | | | |
|---|---|---|---|
| 87541 | 3/1922 | Austria | 401/51 |
| 733800 | 7/1932 | France | 401/51 |
| 919892 | 3/1947 | France | 401/51 |
| 1586203 | 2/1970 | France | 425/DIG. 55 |

*Primary Examiner*—Steven A. Bratlie

*Attorney, Agent, or Firm*—Lerner, David, Littenberg, Krumholz & Mentlik

[57] ABSTRACT

A cosmetic applicator for moldable soft materials which permits the ready formation of a fine point. The body of the applicator has a chamber in which a charge of such soft material is positioned. A piston cooperable with the body acts directly on the charge to force it out the open front end of the chamber into a cap having an interior conical surface. The conical surface and the interior surface of the chamber are sufficiently smooth and non-sticking so that the charge of moldable material is freely slidable within the chamber and readily releasable from the conical surface.

6 Claims, 4 Drawing Sheets

APPLICATOR FOR SOFT MATERIALS WITH TIP FORMING MEANS

This application is a continuation of application Ser. No. 07/025,856 filed Mar. 16, 1987, which is a continuation-in-part of application Ser. No. 06/825,247, filed Feb. 3, 1986, and a continuation-in-part of application Ser. No. 06,852,342, filed Apr. 15, 1986, both of such application Ser. Nos. 06/825,247 and 06/852,342 being incorporated herein by reference and all of such prior applications now abandoned.

BACKGROUND OF INVENTION

This invention relates to an applicator for moldable soft materials as for example, soft cosmetics, crayons, marking pens, eye liners, lip liners and the like. In particular it relates to an applicator which can be used with such soft materials so as to provide a fine point when necessary in a safe manner.

PRIOR ART

The prior art is exemplified by United States and French patents noted below. None of these prior art patents permit the user to form a fresh fine point on a soft, moldable material in a simple, rapid manner.

U.S. Pat. No. 527,803, McCollum, is described as a self-sharpening pencil utilizing the conventional graphite "lead". Sharp knife edges on fingers are used to form the sharpened point.

U.S. Pat. No. 1,055,028, Flynn and Payne describes a paste cup for delivery of paste to the edges of a cigar wrapper in the manufacture of a cigar. The delivery is done by a plunger and orifice.

U.S. Pat. No. 1,270,914, Zimdars, describes a mechanical pencil with a clutch and spring. Fingers 7 are provided to guard against lead slippage from the clutch.

U.S. Pat. No. 1,861,466, Bafetti, is a crayon holder which is sharpened by a conical shaped thimble sharpening tool F which is snapped on when needed. The tool has a cutting or shaving plate f1 which make thin shavings.

U.S. Pat. No. 2,209,849, Seguin describes a lipstick holder where the rotatable plunger has an extension 18 sticking directly into the lipstick 2. Thus when the threaded end of the plunger is turned it pushes the lipstick into the conical interior surface 14 of the cap 15. It appears that the cap is locked into the body 5 by a slotted pin 16 engaging a slot 17.

U.S. Pat. No. 2,559,889, Matthews, describes a lipstick holder utilizing a screw which has prongs 27 embedded into the lipstick.

U.S. Pat. No. 2,606,527, Filak, describes an eyebrow pencil which is self-sharpening. Three or four wires are embedded in the forward portion of the sleeve which act as sharpeners.

U.S. Pat. No. 2,665,696, Weis, is a combination lipstick applicator and sharpener. A separate combined cap and sharpener 60 is described. The interior of the cap has ridges 64 converging towards the closed end of the cap and having an angular conformity to the taper of the lipstick 10. The ridges are stated as being "preferably sharp at their edges as shown in 68 in FIG. 8. However, they can be made rounded or blunt to place the taper into a point and may also be curved to conform to a rounded point." Sharpening is accomplished by pushing the lipstick against the end of the cap and rotating which causes the ridges to act on the lipstick material.

U.S. Pat. No. 2,979,029, Melnikoff, describes an eyebrow pencil and sharpener which refers to prior patent 2,565,715 and utilizes a sharpener 27 having two plates 28 wherein the cap 30 does not contribute to the point.

U.S. Pat. No. 3,077,183, Spatz, relates to the sharpening of relatively soft material such as eyebrow pencils. The patent states that in the sharpening of prior art pencils there is a tendency to clog. Springs are provided to bring the point of the marking pencil into operative engagement with a pointer 28. Pointer 28 appears to comprise a truncated hollow cone 110 having a slot 112, one edge 114 of the slot being defined by the surfaces 115 of a wedge 116. Edge 114 is a cutter edge. The rotation of the cap causes the pointer to rotate under the action of the spring. The cutter bites into the crayon to cut a chip.

U.S. Pat. No. 3,209,730, Aston, describes a mechanical pencil where a crayon 25 is pushed by a screw 16 into sharpener plates 48. Here again the cap plays no part in the formation of the new point on the crayon.

U.S. Pat. No. 3,232,276, Kupersmith and Zeigler describes an eyebrow pencil and sharpener which is typical of the prior art. It has a barrel 10 which houses a feed screw 27. At the end of the feed screw 27 is a crayon supporting thimble 31 which has a socket 32 in which an eyebrow pencil crayon 34 is mounted. What the device accomplishes is that it pushes the crayon into a metal sharpener 39. Although the device has a cap 38, the cap does not participate in the formation of the sharpened end of the crayon.

French Patent 733,800, appears to have material protruding through the end of the cap.

French Patent 919,892, pushes the crayon 1 through the open end of a cap. The pencil case is designated as 9, the threads as 11. Although it is not specifically stated it appears that rotation of the cap causes the crayon to project through the end of the cap and be cut by number 12.

OBJECTS OF INVENTION

One object of this invention is to provide an applicator which can be used with moldable soft materials so as to provide a fine point, when needed, in a simple, rapid manner.

Other objects and advantages of this invention will be apparent from the description and claims which follow, taken together with the appended drawings.

SUMMARY OF INVENTION

This invention comprises broadly the combination of a body having a chamber with an open front end, and a hollow forming cap having an interior conical surface and releasably secured to the body. A charge of moldable soft material such as cosmetic eye liner is inserted into the body and forced into the conical surface by a piston or rod until a conical tip is formed. The cap is then released from the body exposing a fine point of soft material supported by the body and available for use. The interior conical surface and the interior surface of the chamber are sufficiently smooth and non-sticking so that the charge of moldable soft material is freely slidable within said chamber and readily releasable from such conical surface. Preferably the device is so arranged that rotation of the cap on the body causes the piston or rod to force the material into the conical surface.

The charge of soft material can be incorporated either directly or as a preformed shaped material or housed in a cartridge open at both ends. The forcing means can be, but is not limited to, a piston upon which direct pressure is applied or a threaded member movable by rotation and which in turn acts on the charge of soft material.

In one example of the invention the front opening of the body is frusto-conical in shape and the cap's interior conical surface is registerable therewith. In some instances, where a very soft material is used an additional or protector cap is provided which has an interior surface registerable with the exterior surface of the forming cap. With medium soft and less creamy materials the protector cap would not be needed if the interior surface of the forming cap is sufficiently smooth and non-sticking as is the case with "Teflon".

When used with the protector cap the forming cap has slits which form fingers. Upon release of the protector cap the forming cap is preferably drawn backward to release it from the material and body and then slid forward and removed resulting in the formation of a conical tip of the soft material.

In another variation the forming cap has an exterior transverse, circular ridge which registers with the slightly wider interior, transverse circular groove in the protector. When this variation is used the forming cap is permanently housed in the protector cap so that release of the protector cap pulls the forming cap with it, opens and closes the fingers and leaves the desired tip.

The interior surfaces of the tip-forming cap and the chamber are sufficiently smooth and non-sticking to permit the charge to be easily slidable and readily releasable. If the tip-forming cap is made of a resilient plastic with a smooth surface, such as nylon and more particularly "Teflon", removal of the protector permits the fingers to open without sliding back, so that the user may remove the cap by simply sliding forward which both frees it from the body as well as the material if quick release attachment is used.

The piston means preferably comprises a threadable cover and rod. When the cover is screwed onto the end of the body it exerts pressure on the soft material so as to pack it tightly. The protector is preferably interiorly threaded so as to be firmly attached to the body during the formation of the conical tip of material. As the material point wears out, reconnection of the tip-forming cap and protector cap permits the piston to again form a fresh point.

Where the protector is not used, the tip forming cap has a continuous exterior surface and no slits. After sufficient pressure has been exerted by the piston to fill the hollow space in the cap, the cap is slid forward and removed, resulting in the formation of a conical tip of the soft material.

By means of this invention, it is possible to make rapid fresh points on soft cosmetics such as eye liner and lip liner and on soft marking devices such as crayons and marking pens. This production of a fine point permits a safer application than has been possible with previously described devices.

SPECIFIC EXAMPLES OF INVENTION

Figure 1:
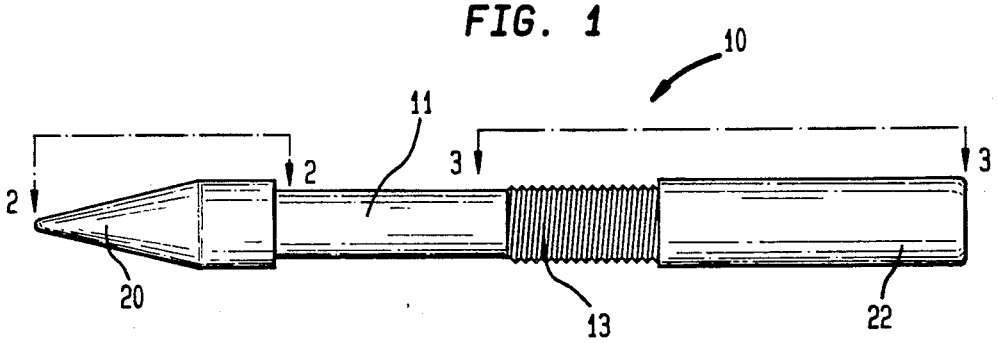
FIG. 1 is a side view of the assembled device made in accordance with one embodiment of this invention.
Figure 2:
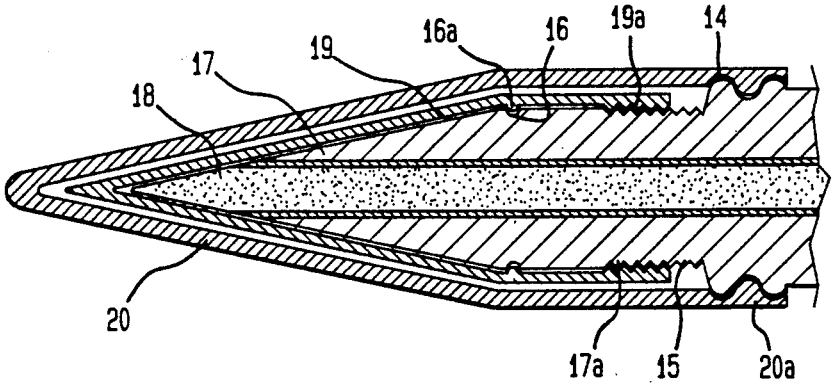
FIG. 2 is a cross-section along line 2—2 of FIG. 1.
Figure 3:
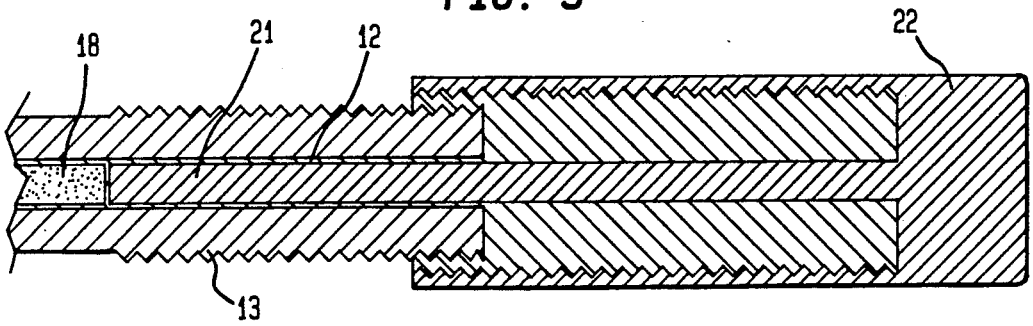
FIG. 3 is a section along line 3—3 of FIG. 1.

Referring now to the drawings, the assembled device 10 illustrates an embodiment of this invention which is particularly useful for very soft materials. It comprises the main body 11, the tip-forming shell 19, the threadable protector end cap 20 and the threadable piston holder 22. The piston holder 22 has internal threading 13*a* which registers with the external threading 13 on body member 11 and permits the piston rod 21 to be inserted and moved forwardly within the chamber 11*a* of hollow body member 11 so as to force material 18 through the orifice 17*a* in the frusto-conical end 17 of the body member 11.

Figures 4, 5, 6:
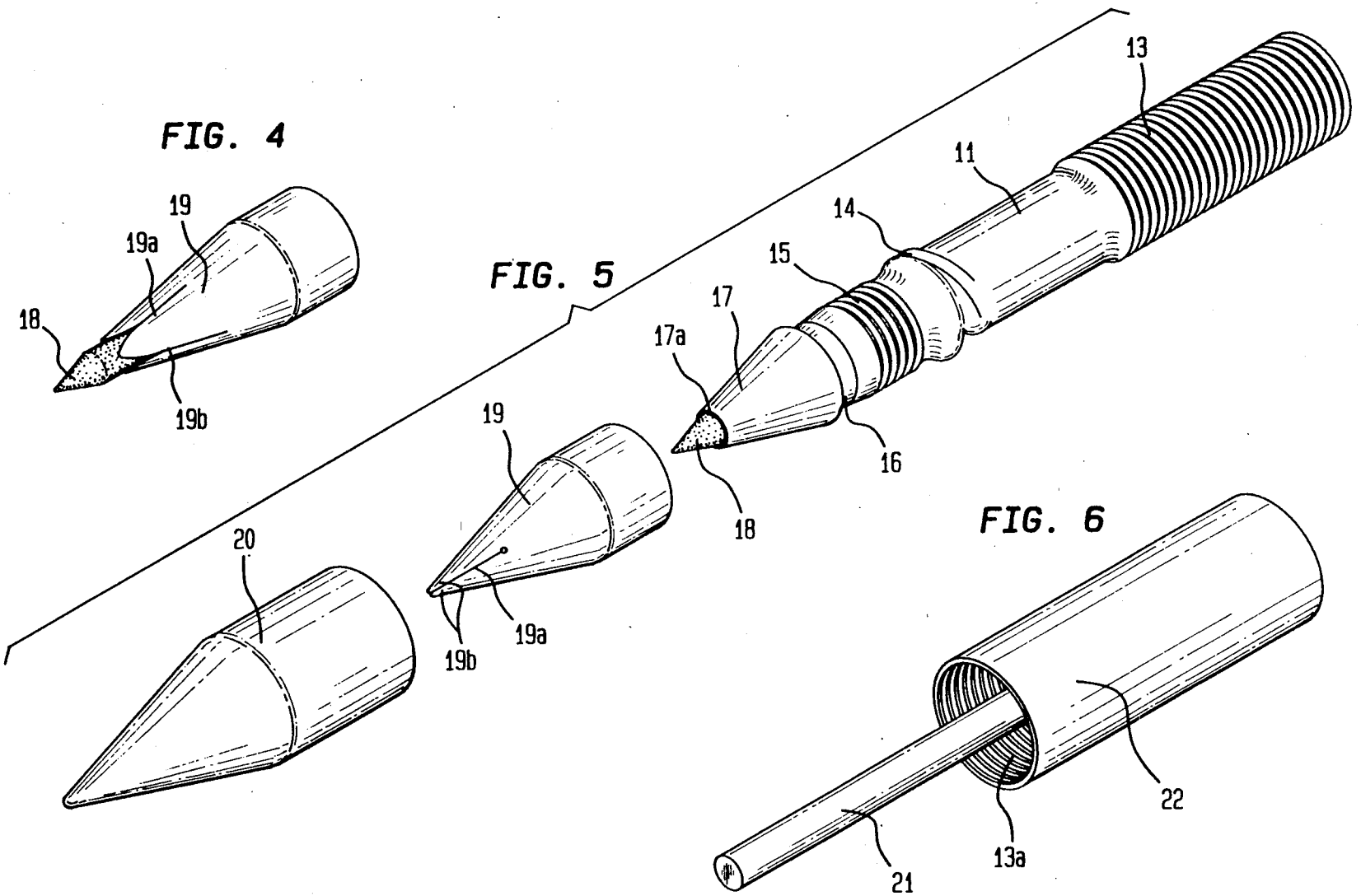
FIG. 4 is a partial end view of the device where the protector cap has been removed and the forming cap slid back partially to release the fine tip of the material.
FIG. 5 is an exploded view of the front portion of the device in dissembled fashion.
FIG. 6 is a view of the rear portion of the device in dissembled fashion.

Prior to forcing the material out, the applicator shell 19 with slits forming fingers 19*b* is slid tightly over the frusto-conical end 17 and then the end retaining cap 20 which has interior threading 20*a* is threaded on to the speed thread 14. Shell 19 has interior threading 19*a* and a snap notch 16*a* cooperable with threading 17*a* and recess 16 in the main body. When the applicator is to be first used, forming shell 19 is threaded onto end 17 of the body and the end cap 20 is threaded onto the snap or fast thread 14 on the body. Then soft material 18 is added to the chamber 11*a* of body member 11. After this has been done the piston means 22 is threaded onto the back thread 13 so that rotation of 22 causes the piston rod 21 to push the material forward until it is tightly packed. The end cap 20 is taken off completely and the forming shell 19 with its fingers 19*b* formed by slots 19*a* is pushed backward so that the conical tip of the material 18 protrudes as shown in FIG. 4. Then the shell 19 is moved forward and slid off completely leaving the conical tip 18 exposed.

Figure 7:
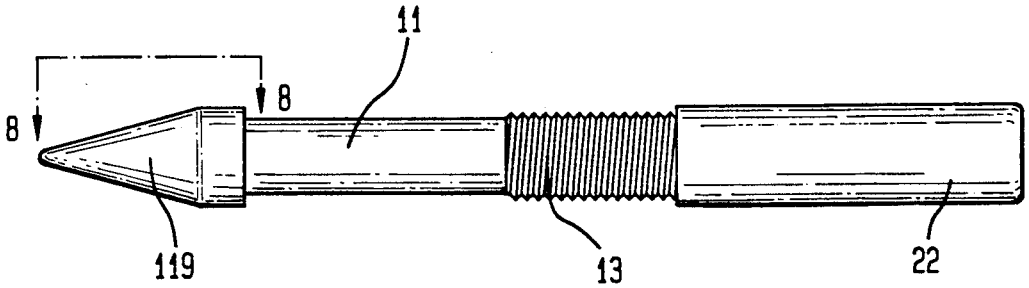
FIG. 7 is a side view of the assembled device where no protector cap is used.
Figure 8:
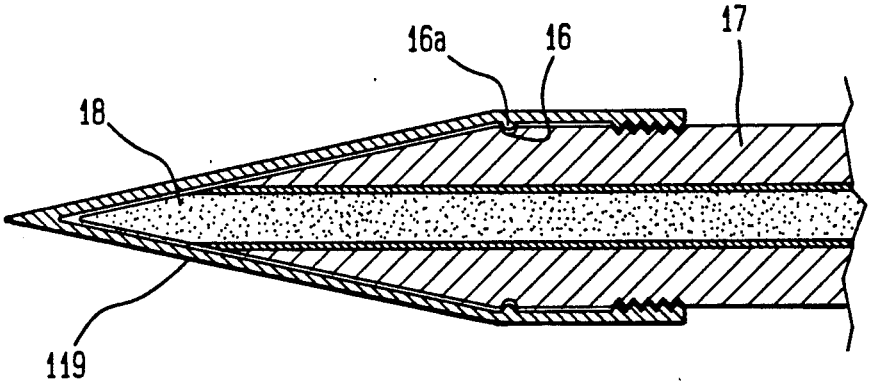
FIG. 8 is a cross-section along line 7—7 of FIG. 7.
Figure 9:
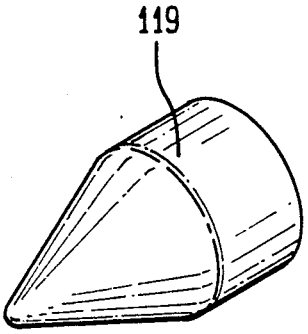
FIG. 9 is a perspective view or the tip forming cap used without the protector.

Referring now to the embodiment illustrated in FIGS. 7, 8 and 9, the tip forming cap 119, which has a continuous outer surface and a conical inner surface, is threaded onto the end 17 of the body but no protector cap is used. As in the other embodiment, the soft material 18 is added to the chamber 11*a* of body member 11 and the piston 22 threaded onto the back thread 13 so that rotation of 22 causes the piston rod 21 to push the material forward into cap 119 until it is tightly packed. Then the cap 119 is unthreaded from end 17 and moved forward and off, leaving the conical tip 18 exposed for use.

Figure 10:
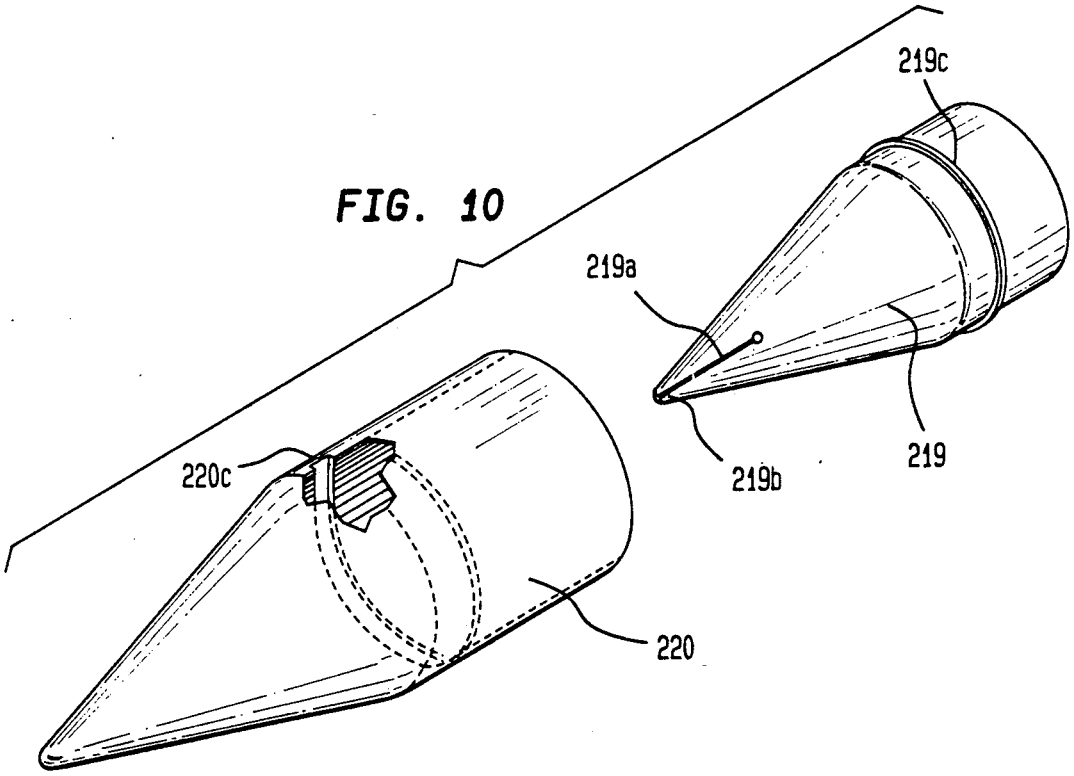
FIG. 10 is an exploded view of another embodiment of this invention wherein the tip-forming cap has slits but normally is housed and slidable within the protector.

Referring now to the embodiment illustrated in FIG. 10, the tip-forming cap 219 has slits 219*a* forming fingers 219*b*. On its outer surface is a narrow shoulder or circumferential ridge 219*c*. The protector 220 has a circumferential groove 220*c* on its interior surface. Groove 220*c* and ridge 219*c* are registrable with one another, but the groove is wider than the ridge so that when the cap is positioned within the protector it can slide slightly when the protector is removed, causing the fingers to open and release the material. Once the cap is assembled within the protector it is normally not removable and is removed when the protector is removed, so that the user has less pieces to handle. The protector and cap have similar interior threading and notches as the previous embodiment illustrated in FIGS. 1-6 and attach and detach from the body in a similar manner.

I claim:

1. An applicator for moldable soft material which permits the ready formation and exposure of a fresh point, comprising:

a body having a chamber containing a charge of moldable soft material, said body including a front end having an opening communicating with said chamber and a frusto-conical surface extending about said opening;

cap means adapted to be detachably secured to said front end of said body, said cap means having an interior conical surface which includes a first portion which is registrable in tight fitting relationship with said frusto-conical surface of said body when said cap means is secured to said front end of said body and a second portion which forms a conical recess; and manually actuable pushing means movable within said chamber of said body and in direct contact with the rear of said charge of soft material for forcing said charge of soft material through said opening in said body and into said conical recess in said cap means when said cap means is secured to said body, the interior surface of said chamber and said interior conical surface of said cap means each being sufficiently smooth and non-sticking so that said charge of soft material is freely slideable within said chamber of said body and readily releasable from said interior conical surface of said cap means, whereby actuation of said pushing means pushes said charge of soft material into said conical recess to form a fresh point on the end of said charge of soft material and detaching of said cap means exposes said fresh point.

2. An applicator in accordance with claim 1 wherein said cap means is adapted to be detachably secured to said front end of said body by means of cooperable threading provided on said body and on said cap means.

3. An applicator in accordance with claim 1 wherein said pushing means comprises a piston movably mounted within said chamber of said body and a piston holder connected to said piston and threadably mounted on said body, whereby rotation of said piston holder causes said piston to move forward within said chamber of said body.

4. An applicator for moldable soft materials which permits the ready formation and exposure of a fresh point for such materials, comprising:

a) a body including ak chamber having a front frusto-conical portion with an open front end;

b) a charge of moldable soft material spaced within said chamber and freely slidable therein;

c) manually actuable piston means movable within said chamber and abutting the rear of said charge but being unattached thereto; and d) cap means having an interior conical surface and being detachably connected to said body so as to register with said front open end of said chamber, said cap means including a tip-forming cap which is hollow, has a conical interior surface registrable with said frusto-conical front end, has slits forming fingers at its front end and is detachably connected to said body, and an exterior protector cap having an interior surface registrable with the exterior surface of said tip-forming cap and detachably connected to said body;

the interior surface of said chamber and said conical surface of said cap means being sufficiently smooth and non-sticking so that said charge is freely slidable within said chamber and readily releasable from said conical surface; said applicator being characterized in that when said cap means is attached to said body, actuation of said piston means pushes said charge into said conical surface to form a fresh point and detaching of said cap means exposes a fresh point on the end of said charge of soft material.

5. An applicator for moldable soft materials which permits the ready formation and exposure of a fresh point for such materials, comprising:

a) a body including a chamber having a front frusto-conical portion with an open front end;

b) a charge of moldable soft material spaced within said chamber and freely slidable therein;

c) manually actuable piston means movable within said chamber and abutting the rear of said charge but being unattached thereto; and d) cap means having an interior conical surface and being detachable connected to said body so as to register with said front open end of said chamber, said cap means including a tip-forming cap which is hollow, has a conical interior surface registrable with said frusto-conical front end, has slits forming fingers at its front end and is detachably connected to said body, and a protector cap having an interior surface registrable with the exterior surface of said tip-forming cap and detachably connected to said body, said interior protector cap surface and exterior tip-forming cap surface having cooperable means for normally holding said tip-forming cap within said protector cap but permitting said tip-forming cap to slide slightly within said protector cap thus allowing the fingers to open when the protector cap is removed from said body, the interior surface of said chamber and said conical surface of said cap means being sufficiently smooth and non-sticking so that said charge is freely slidable within said chamber and readily releasable from said conical surface; said applicator being characterized in that when said cap means is attached to said body, actuation of said piston means pushes said charge into said conical surface to form a fresh point and detaching of said cap means exposes a fresh point on the end of said charge of soft material.

6. An applicator made in accordance with claim 5 wherein said cooperable means comprises a transverse ridge on the exterior surface of said tip-forming cap and a slightly wider transverse groove on the interior surface of said protector cap.

* * * * *

UNITED STATES PATENT AND TRADEMARK OFFICE

CERTIFICATE OF CORRECTION

PATENT NO. : 5,102,248

DATED : April 7, 1992

INVENTOR(S) : Welschoff

It is certified that error appears in the above-identified patent and that said Letters Patent is hereby corrected as shown below:

Column 5, line 60, "ak" should read --a--.

Column 6, line 49, "," should read --;--.

Signed and Sealed this

Sixth Day of July, 1993

Michael K. Kirk

*Attest:*

MICHAEL K. KIRK

*Attesting Officer*

*Acting Commissioner of Patents and Trademarks*